US009010246B2

(12) United States Patent
Leppanen

(10) Patent No.: US 9,010,246 B2
(45) Date of Patent: Apr. 21, 2015

(54) SURFACE BLASTING PRODUCT

(75) Inventor: Jarmo Uolevi Leppanen, East Rand (ZA)

(73) Assignee: Sandvik Mining and Construction RSA (Pty) Ltd, East Rand (ZA)

( * ) Notice: Subject to any disclaimer, the term of this patent is extended or adjusted under 35 U.S.C. 154(b) by 0 days.

(21) Appl. No.: 13/639,556

(22) PCT Filed: Apr. 6, 2011

(86) PCT No.: PCT/ZA2011/000019

§ 371 (c)(1),
(2), (4) Date: Dec. 5, 2012

(87) PCT Pub. No.: WO2011/127492

PCT Pub. Date: Oct. 13, 2011

(65) Prior Publication Data

US 2013/0145950 A1 Jun. 13, 2013

(30) Foreign Application Priority Data

Apr. 6, 2010 (ZA) ..... 2010/02369

(51) Int. Cl.

| | |
|---|---|
| ***F42D 3/04*** | (2006.01) |
| ***F42D 1/22*** | (2006.01) |
| ***F42D 1/00*** | (2006.01) |

(Continued)

(52) U.S. Cl.

CPC ... *F42B 3/10* (2013.01); *F42B 3/08* (2013.01); *F42D 3/04* (2013.01); *F42D 1/02* (2013.01); *F42D 1/00* (2013.01); *F42D 1/22* (2013.01); *F42B 1/02* (2013.01)

(58) Field of Classification Search

CPC ..... F42B 1/00; F42B 1/02; F42B 3/00; F42B 3/02; F42B 3/08; F42B 3/087; F42B 3/10; F42D 1/00; F42D 1/02; F42D 1/08; F42D 1/22; F42D 3/00; F42D 3/04

USPC ..... 102/301, 302, 305, 306, 307, 308, 309, 102/310, 312, 313, 319, 321, 321.1, 324, 102/331, 332, 293; 299/13; 86/50

See application file for complete search history.

(56) References Cited

U.S. PATENT DOCUMENTS

| | | | |
|---|---|---|---|
| 2,247,169 | A | 6/1941 | Gilbertson |
| 5,233,926 | A | 8/1993 | Carmichael et al. |

(Continued)

FOREIGN PATENT DOCUMENTS

| | | |
|---|---|---|
| EP | 1 338 758 | 8/2003 |
| JP | 59-165793 | 9/1984 |

(Continued)

OTHER PUBLICATIONS

Notice of Reasons for Rejection (with English translation) for Japanese Patent Application No. 2013-504027, dated Sep. 3, 2013.

(Continued)

*Primary Examiner* — James S Bergin

(74) *Attorney, Agent, or Firm* — Morgan, Lewis & Bockius LLP

(57) ABSTRACT

A surface blasting product which includes a container, a receptacle which contains adhesive which is displaceable to adhere the container to a rock, and an explosive charge, inside the container, which can be ignited to fragment or displace the rock.

16 Claims, 6 Drawing Sheets

(51) Int. Cl.

| | |
|---|---|
| ***F42D 1/02*** | (2006.01) |
| ***F42B 1/02*** | (2006.01) |
| ***F42B 3/08*** | (2006.01) |
| ***F42B 3/02*** | (2006.01) |
| ***F42B 3/10*** | (2006.01) |

(56) References Cited

U.S. PATENT DOCUMENTS

| | | | | |
|---|---|---|---|---|
| 6,318,272 | B1 * | 11/2001 | Mey | 102/302 |
| 6,453,788 | B1 * | 9/2002 | Lebet et al. | 86/50 |
| 6,672,673 | B1 | 1/2004 | Miller et al. | |
| 7,555,986 | B2 * | 7/2009 | Givens et al. | 102/331 |
| 2005/0126420 | A1 * | 6/2005 | Givens et al. | 102/310 |

FOREIGN PATENT DOCUMENTS

| | | |
|---|---|---|
| JP | 1-120306 | 5/1989 |
| JP | 1-121700 | 5/1989 |
| RU | 2005988 | 1/1994 |
| RU | 2119054 | 9/1998 |
| RU | 2159854 | 11/2000 |
| SU | 1411499 | 11/1986 |

OTHER PUBLICATIONS

International Search Report for PCT/ZA2011/000019, dated Sep. 13, 2011.

Office Action for Russian Patent Application No. 2012-146978/03 (075459), dated Feb. 11, 2014.

* cited by examiner

SURFACE BLASTING PRODUCT

RELATED APPLICATIONS

The present application is a U.S. National Phase Application of International Application No. PCT/ZA2011/000019 (filed 6 Apr. 2011) which claims priority to South African Application No. 2010/02369 (filed 6 Apr. 2010).

BACKGROUND OF THE INVENTION

This invention relates to a surface blasting product.

In mining and excavation processes, underground and on surface, there are, inevitably, boulders and rocks which can be difficult to handle because they have not been sufficiently fragmented during a primary blast or a caving step, or which may have been displaced from non-blasted areas. Secondary blasting techniques or impact devices can be used to reduce the sizes of these materials.

Secondary blasting methods are described in general in the specification of U.S. Pat. No. 5,233,926. An example of a secondary blasting charge is given in U.S. Pat. No. 2,247,169.

Rocks which are on the ground can, with a reasonable degree of safety, be broken using non-explosive or explosive techniques or impact hammers. When the rocks are overhead, for example if rocks in a chute or box hole form a blockage, then blasting of the rocks to eliminate the blockage can be, at best, problematic and, at worst, highly dangerous.

If the problem can tackled from above the blockage then a relatively large quantity of explosive could be required. In this event the energy which is released can be destructive to a structure which defines a passage in which the rock is located.

U.S. Pat. No. 5,233,926 describes the use of a shaped secondary blasting charge which contains a viscous adhesive explosive. In one example the charge is supported on a pole which is manipulated to allow the explosive charge to be adhesively bonded to a rock. This process can be carried out with a reasonable degree of safety. For a variety of reasons though the use of explosive material which is adhesive is not always successful, practical, nor desirable.

U.S. Pat. No. 2,247,169 describes a surface blasting shell in which a base flange on a capsule is coated with an adhesive to allow the capsule to be adhered to a rock to be blasted. This patent does not however describe a safe technique for using the blasting shell in an overhead application.

An object of the present invention is to provide a blasting product which can be used in a controlled manner with a substantial degree of safety to fragment or displace rock at an overhead location, while limiting the quantity of energy which is released, or otherwise directing the energy which is released, so that the likelihood of damage being caused to supporting structure is reduced.

SUMMARY OF THE INVENTION

The invention provides a surface blasting product which includes a container, an explosive inside the container, a mechanism for initiating the explosive, a receptacle which contains an adhesive, and an actuator arrangement for causing adhesive to be displaced from the receptacle onto an outer surface of the container.

Preferably a device for mixing the adhesive, when displaced from the receptacle, is located adjacent the outer surface of the container. This arrangement results in effective mixing, and subsequently placement, of the adhesive.

Preferably the container has a recessed formation and the adhesive is displaced into the recessed formation, between the container and a rock to be blasted.

The actuator arrangement can take on any of a number of forms. In one preferred embodiment of the invention the actuator includes a flexible bladder or cartridge, inside the receptacle, which contains the adhesive e.g. in a fluent form. A connection is provided for introducing a pressurised fluid, e.g. air or water, into the receptacle thereby to pressurise the bladder or cartridge externally and so displace adhesive from the bladder or cartridge, for subsequent mixing (if required) and placement.

In a variation of the invention the receptacle includes a cylinder which contains the adhesive and the actuator includes a piston which is movable inside the cylinder to displace adhesive from the cylinder.

The recessed formation is preferably surrounded by a flexible seal.

The container may be of any suitable form but preferably has a conical or pyramidal shape. The recessed formation may be located at a base of the cone or pyramid, as the case may be.

The blasting product may include a support to which the container is mounted. The container may be movable relative to the support. This may be done in any appropriate way and for example use may be made of a cylinder and piston arrangement, a flexible bellows, a tube, or the like. The invention is not limited in this respect. In one form of the invention the container is located at least partly within a bellows which is mounted to the support and, when the bellows is internally pressurised, the container is thereby forced away from the support. In this way the recessed formation, which is filled with adhesive, can be brought into close contact with a rock which is to be blasted. The recess is then filled with a quantity of the adhesive.

In a variation of the invention a biasing device which may form part of, or which may be included in, the bellows acts to urge the recessed formation towards the rock. Thereafter a quantity of the adhesive is pumped into a space formed by the recessed formation between the rock and the container.

In a preferred form of the invention a shaped charge is included inside the container. The shaped charge is designed to concentrate energy, released upon initiation of the explosive, onto a rock against which the recessed formation bears. The shaped charge is preferably formed from, or includes, a relatively heavy metal, for example copper or iron. The shaped charge, itself, may have a conical or pyramidal shape.

The blasting product may be part of a compound unit which includes a plurality of the blasting products which are suitably interconnected. Preferably the plurality of blasting products are individually mounted to the support.

The support may include a flexible joint which may be in the nature of a universal joint and which, in use, is mountable to a boom or similar elongate component in a manner which permits at least a limited degree of movement of the container relative to the elongate component.

The adhesive may be formed from a two-component polyester resin, typically of the kind used in a ground support application. This type of resin is preferably fast-setting, a desirable feature. Resin components may be packed directly into the receptacle in a known manner or into any suitable type of bladder arrangement. Another preferred possibility is that the adhesive is a standard resin in a cartridge of the kind used for installation of a rock bolt. These examples are non-limiting.

A particularly effective arrangement makes use of a resin adhesive, expelled from a cartridge, with a mixing device between a rock surface to which the adhesive is applied, and an opposed surface of the container which is then adhered by the mixed adhesive to the rock surface.

Thus, in one form of the invention, the receptacle has at least a first compartment and a second compartment. The adhesive includes, at least, a base material and an activator. The base material is in the first compartment and the activator is in the second compartment. A mixing device causes mixing of the base material and the activator when displaced from the receptacle. The adhesive may be contained in a cartridge which, in turn, is positioned inside the flexible bladder or inside the cylinder. The cylinder may, in one form of the invention be the cartridge.

The adhesive sets only after it has been mixed. Typically a standard resin capsule has a small strip of hardener (catalyst) along a length of a resin cartridge. The main component cannot harden without prior effective mixing with the catalyst. Mixing also creates friction and this leads to a temperature rise which accelerates the hardening process.

BRIEF DESCRIPTION OF THE DRAWINGS

The invention is further described by way of examples with reference to the accompanying drawings in which.

DESCRIPTION OF PREFERRED EMBODIMENTS

Figure 1:
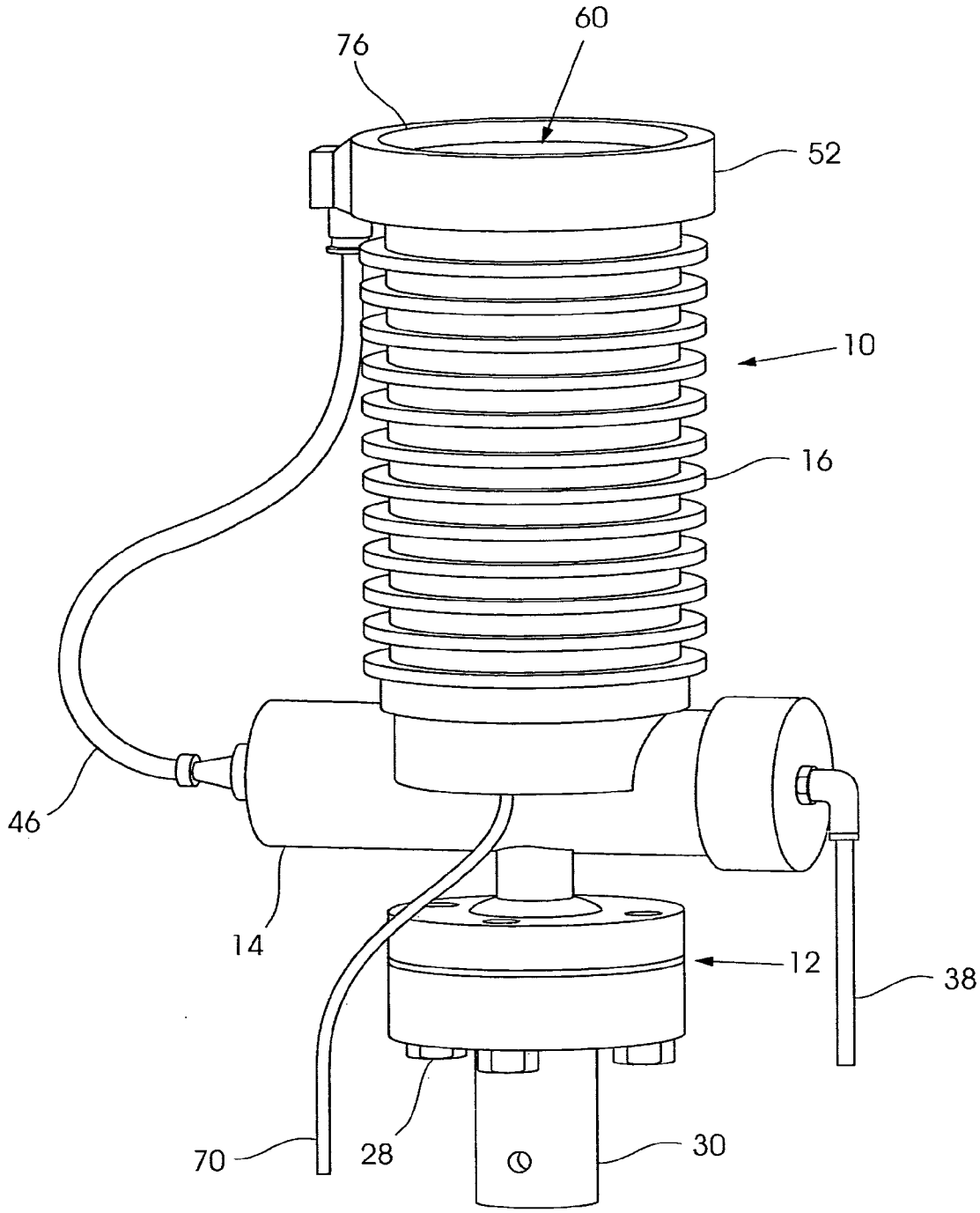
FIG. 1 illustrates a surface blasting product according to one form of the invention, from one side.
Figure 2:
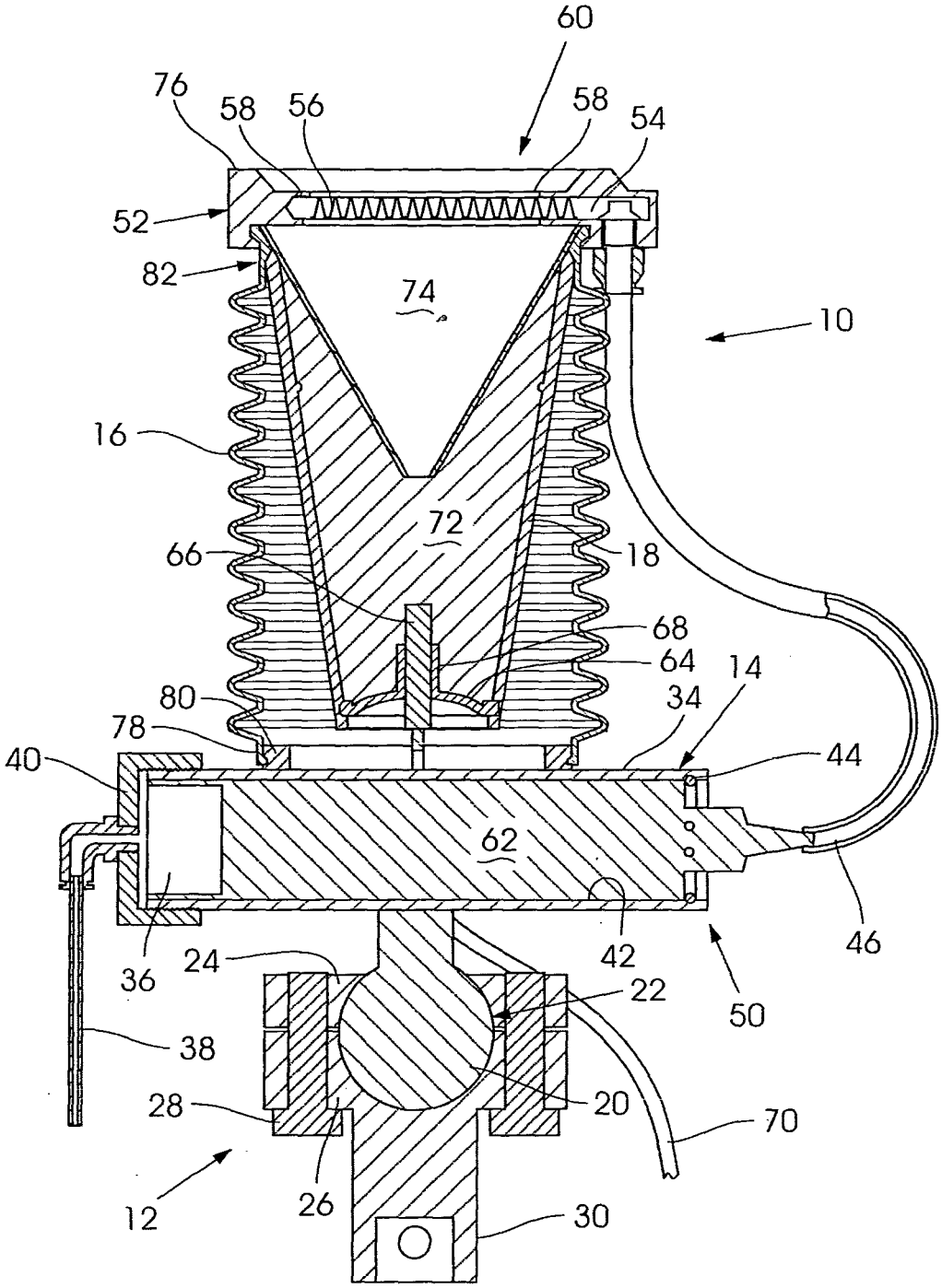
FIG. 2 is a cross-sectional side view of the blasting product shown in FIG. 1.

FIGS. 1 and 2 of the accompanying drawings illustrate from one side, and from one side in cross-section, respectively, a surface blasting product 10 according to the invention.

The blasting product has a support 12, a receptacle 14, a bellows 16 and an explosives container 18 which is substantially or completely housed inside the bellows.

The support 12 has a spherical member 20 located inside a cavity 22, of complementary shape to the member, formed inside opposing support sections 24 and 26 respectively which are kept together by means of adjustable bolts 28. A short shaft 30 projects from the support section 26 and allows the product 10 to be mounted to an external support structure, as is described hereinafter with reference to FIG. 3.

The receptacle 14 is in the form of an elongate cylinder 34 with an internal piston 36. A conduit 38, connected to a cap 40 on the cylinder, discharges onto a trailing side of the piston.

Inside the receptacle is a disposable adhesive cartridge 42 which is surrounded at a discharge end by an O-ring 44 which acts as a seal. The cartridge has an outlet which is connected to a flexible conduit 46 at an end 50 of the receptacle. The conduit 46 extends to a cap 52 which has an inner volume 54 which houses mixing screws 56. Discharge holes 58 couple the volume 54 to an outwardly facing recessed formation 60.

A fluent adhesive material 62 is housed inside the cylinder and fully occupies an internal volume of the cylinder. The material 62 may be of the kind described hereinbefore e.g. a two-ingredient substance which is activated when the ingredients are mixed with each other. The invention is not limited in this respect.

The container 18 is roughly in the form of a truncated cone. A seal 64 is engaged with an inner lower end of the container (see FIG. 2) and a detonator 66 is mounted to a centrally positioned sleeve 68 in the seal. A lead 70 of indeterminate length is connected to the detonator in a known manner. The container is filled with an explosive 72 of any appropriate type known in the art.

A shaped charge insert 74, inside the container, is located directly adjacent the cap 52, i.e. at a large end or base of the truncated conical container. The insert is made from steel, iron, copper or a similar heavy metal. Preferably, as shown in FIG. 2, the insert has a generally conical or pyramidal shape.

The outwardly facing recessed formation 60 is surrounded by a wall 76. Preferably the wall is flexible to some extent so that when the wall bears against a rock surface (not shown) a reasonable seal is formed at an interface between the wall and the rock surface. Alternatively, instead of the wall, the cap is formed with a number of projections, or legs, which are spaced apart from one another. If a standard ground support resin is, discharged from the cartridge 42 then, by the time the resin emerges from the holes 58, the mixed resin is highly viscous, in the form of a stiff putty, and is not a free flowing liquid. The resin does thus not easily flow from the recessed formation 60 for, at this time, the hardening process has already been well advanced.

The bellows 16 has a circular flange 78 which is engaged with a rim 80 which extends from an outer surface of the receptacle 14. At an opposed end 82 the bellows is fixed to appropriate structure on the cap 52.

Figure 3:
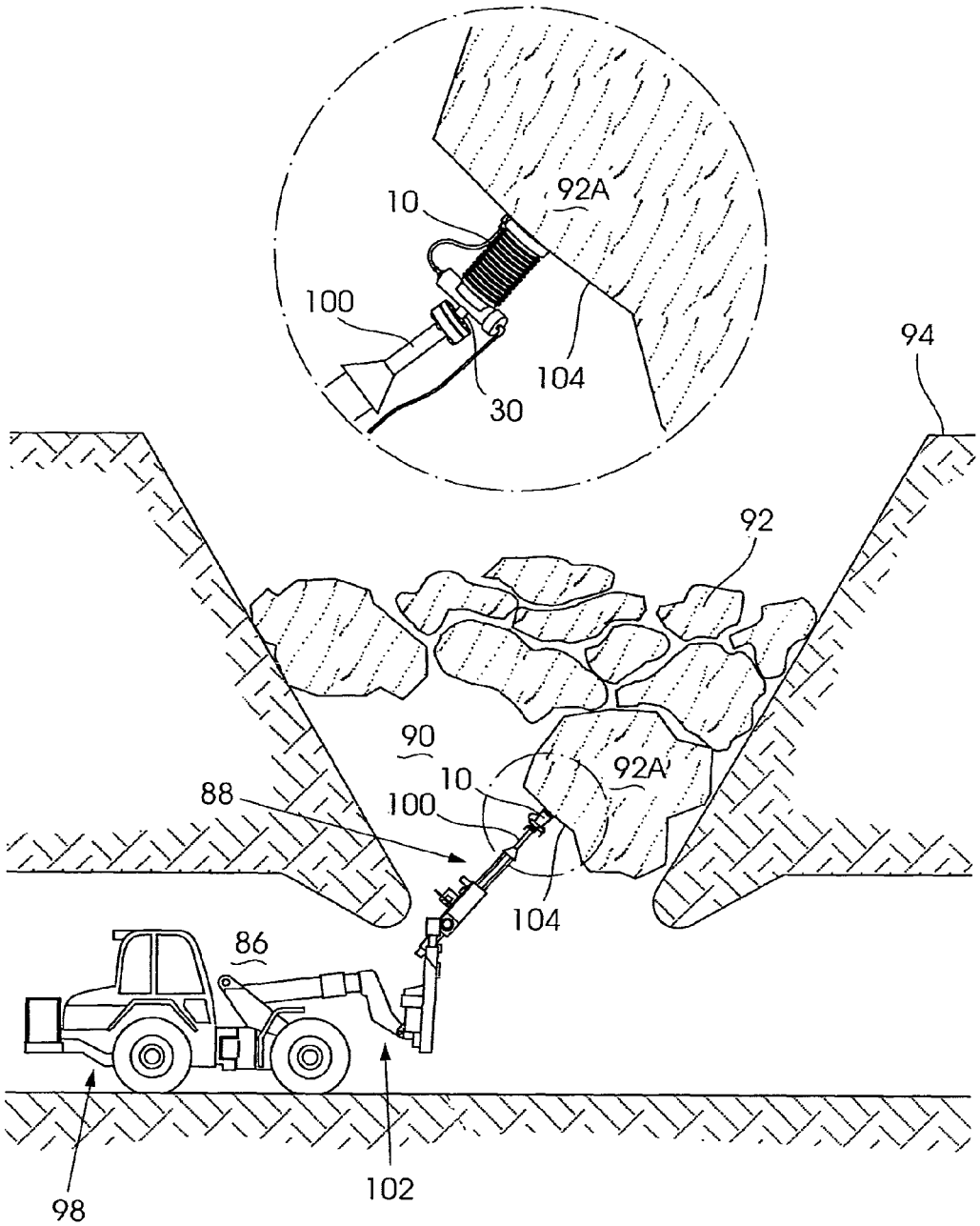
FIG. 3 illustrates one way of using the blasting product of FIG. 1.

FIG. 3 depicts a block caving mining method in which an underground excavation or haulage 86 is located at a discharge end 88 of a funnel-shaped passage 90. In a block caving system appropriate machinery, not shown, is used to move rocks 92 over an upper surface 94 so that the rocks can fall through the passage 90 to the lower level 86. If one or more of the rocks, for a variety of reasons, become wedged in an overhead position the passage 90 is no longer usable. Due to the techniques which are used in a block caving mining method it is normally not easily possible to gain access to an upper surface of the rocks 92 in order to blast the rocks and so remove the blockage. This means that the only way to clear the blockage, in a block caving system, is to undertake the highly dangerous step of blasting from below.

FIG. 3 illustrates a machine 98 of any appropriate kind which has a boom 100. A product 10 of the type shown in FIGS. 1 and 2 is attached to an upper end of the boom. The shaft 30 is designed to facilitate this attachment process. The boom is held on an articulated support 102 which is positioned so that an operator of the machine, while working in a position of relative safety, can cause the boom to be extended thereby to bring the product 10 into firm engagement with a side (usually an underside) 104 of a chosen rock 92A.

The spherical member 20 is held fairly tightly by the sections 24 and 26 but, nonetheless, can pivot to some extent when sufficient force is applied to the product as the product is urged upwardly by the boom. This ensures that the recessed formation comes into close engagement with the rock surface 104.

The bellows, depending on its structure, can exhibit different functions. In one form of the invention it is possible to inflate an interior of the bellows (between opposing surfaces of the bellows and the container 18) using air or water from a pressurised source, not shown, so that the cap 52 is displaced away from the receptacle 14. In a different form of the invention the bellows has a resilient characteristic and is in the nature of a spring. If the boom presses the product against the underside 104 of the rock then a certain degree of yielding of the bellows takes place. The compressed bellows nonetheless attempts to expand and this keeps the sealing wall 76 firmly in contact with the underside 104.

Pressurised water from a source, not shown, is then introduced through the conduit 38 into the cylinder, behind the piston which is thereby advanced. The fluent constituents of the adhesive 62 are forced through the conduit 46. Movement of the piston helps to some extent in the mixing of the adhesive constituents. As the constituents flow through the mixing screws 56 complete mixing takes place and the emerging mixed fluent adhesive passes through the holes 58. The formation 60 is then filled with the adhesive which is also brought into contact with the opposing surface 104 of the rock 92A.

Force is maintained on the product 10 until such time as the adhesive has set. At this point the boom 100 is removed and the product 10 is left behind, adhesively attached to the underside 104 of the rock. Via the lead 70 the detonator 66 is fired at a suitable time and the explosive 72 is ignited. The explosive force generated upon ignition of the explosive is shaped or directed by the insert 74 which acts as a charge concentrator. A substantial impact force is exerted on the rock 92A which is thereby fragmented or moved to such an extent that the blockage caused the rocks in or above the passage is released.

It is noted that the mixing screws 56 are located on a surface of the container which is adhered by the resin adhesive to an opposing rock surface. This has been found to be particularly advantageous for the mixing and placement of a standard resin, of the kind normally used to install a rock bolt, is effectively done and the resin then firmly secures the explosive-filled container to the rock.

Figure 4:
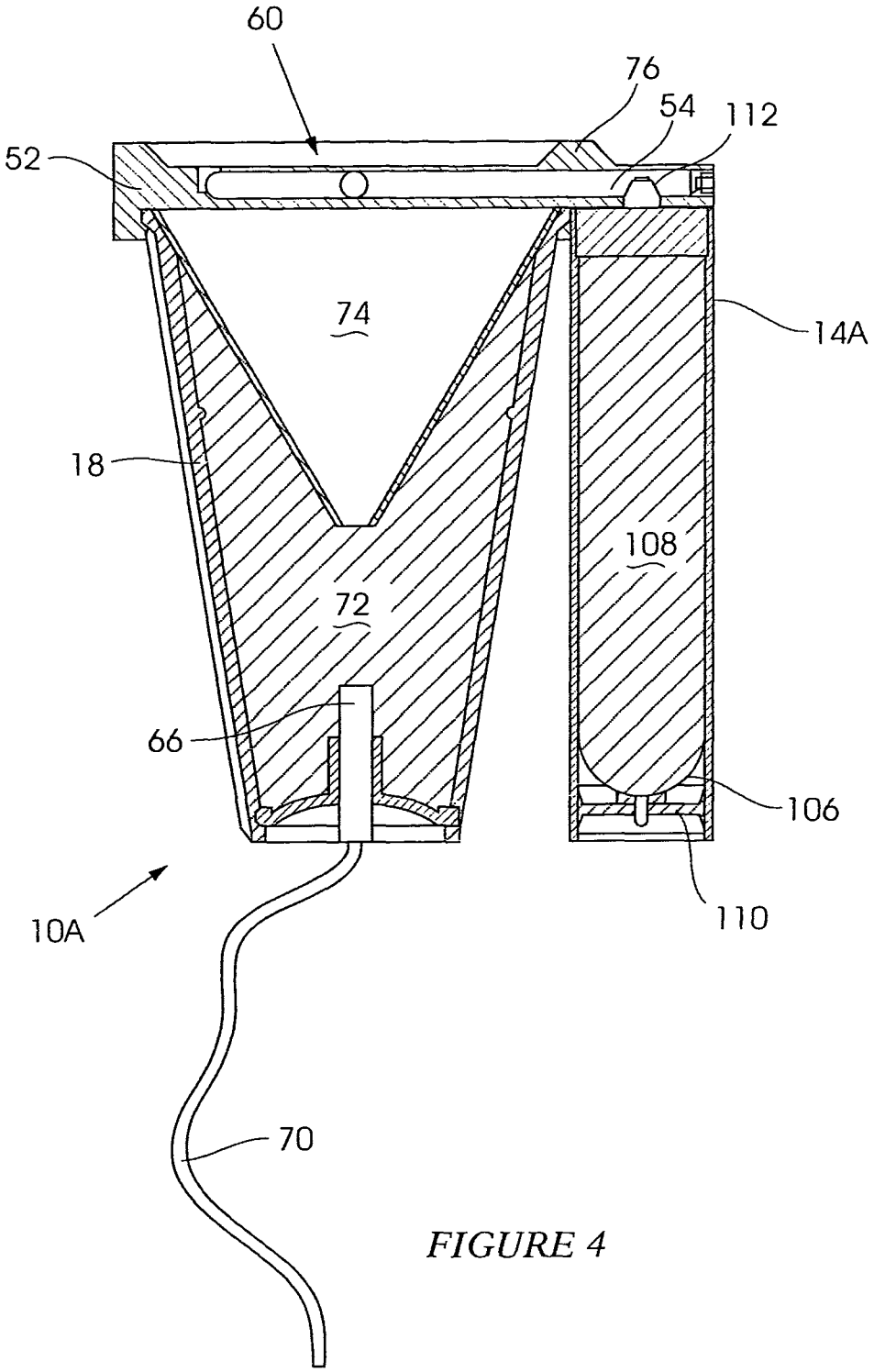
FIG. 4 is similar to FIG. 2 and illustrates in cross-section and from one side, a blasting product according to a second form of the invention.

FIG. 4 shows, in cross-section and from one side, a modified surface blasting product 10A. Components in the product 10A which are the same as components in the product 10 bear like reference numerals and are not further described herein.

The receptacle 14 is replaced by a receptacle 14A which contains a flexible bladder 106 which is filled with a fluent one- or two-part adhesive 108. A lower end of the bladder is coupled to a piston 110 which can be moved upwardly (in the drawing) thereby to compress the bladder and force adhesive through a discharge nozzle 112 of the receptacle. Mixing of the adhesive or its constituents takes place by means of appropriate mixing formations, not shown in FIG. 4, adjacent the nozzle 112.

The piston can be moved in any appropriate way. Typically use would be made of water or air pressure to advance the piston along the receptacle 14A. In some applications though it might be possible to make use of a mechanical device to move the piston. This would be the case if the rock which is to be broken is more readily accessible, for example not particularly high or even, in some cases, on the ground. Under these conditions it is possible to move the piston by using a suitable actuator which is manually operated.

When the piston 110 is advanced, typically through the use of water pressure, a significant upwardly directed force is produced which, apart from expelling the adhesive constituents from the bladder 106, tends to urge the container 18 with its explosive charge towards the rock in question. It is therefore not necessary to use the bellows 16. Reliance is instead placed on the use of the boom 100 or on the force which is generated via the piston 110 to maintain the explosive product in contact with a selected surface of the rock which is to be blasted until such time as the adhesive 108, on an active face of the blasting product, and on an opposed rock surface, has set.

In a variation of the invention the container 18 can, at least at a lower end, be formed to act as a piston which in turn is positioned inside a cylinder, not shown. Pressurised water or other fluid is then used to displace the piston from the cylinder and so move the container firmly into contact with a rock which is to be blasted.

Figure 5:
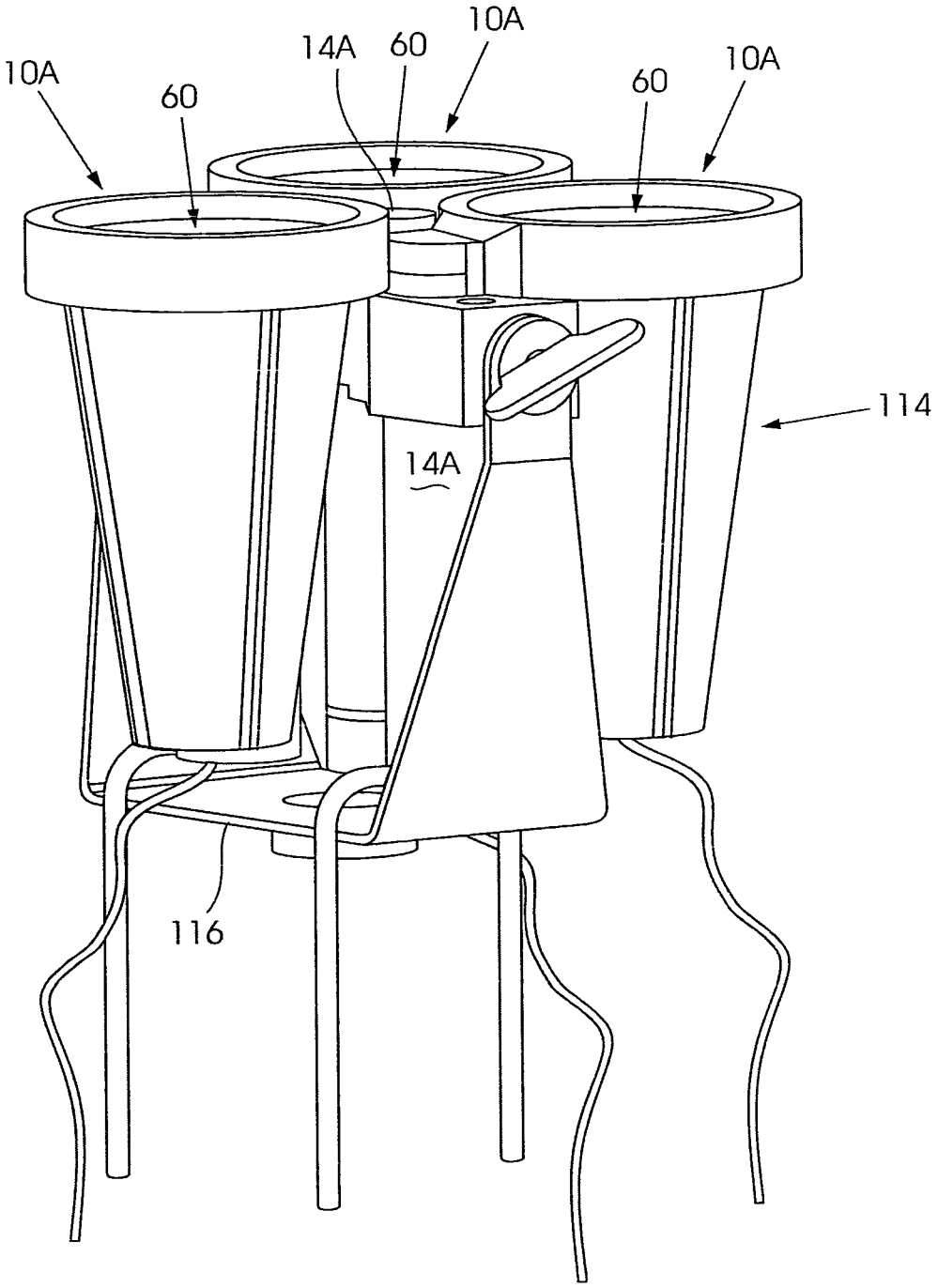
FIG. 5 shows a compound blasting assembly according to the invention.
Figure 6:
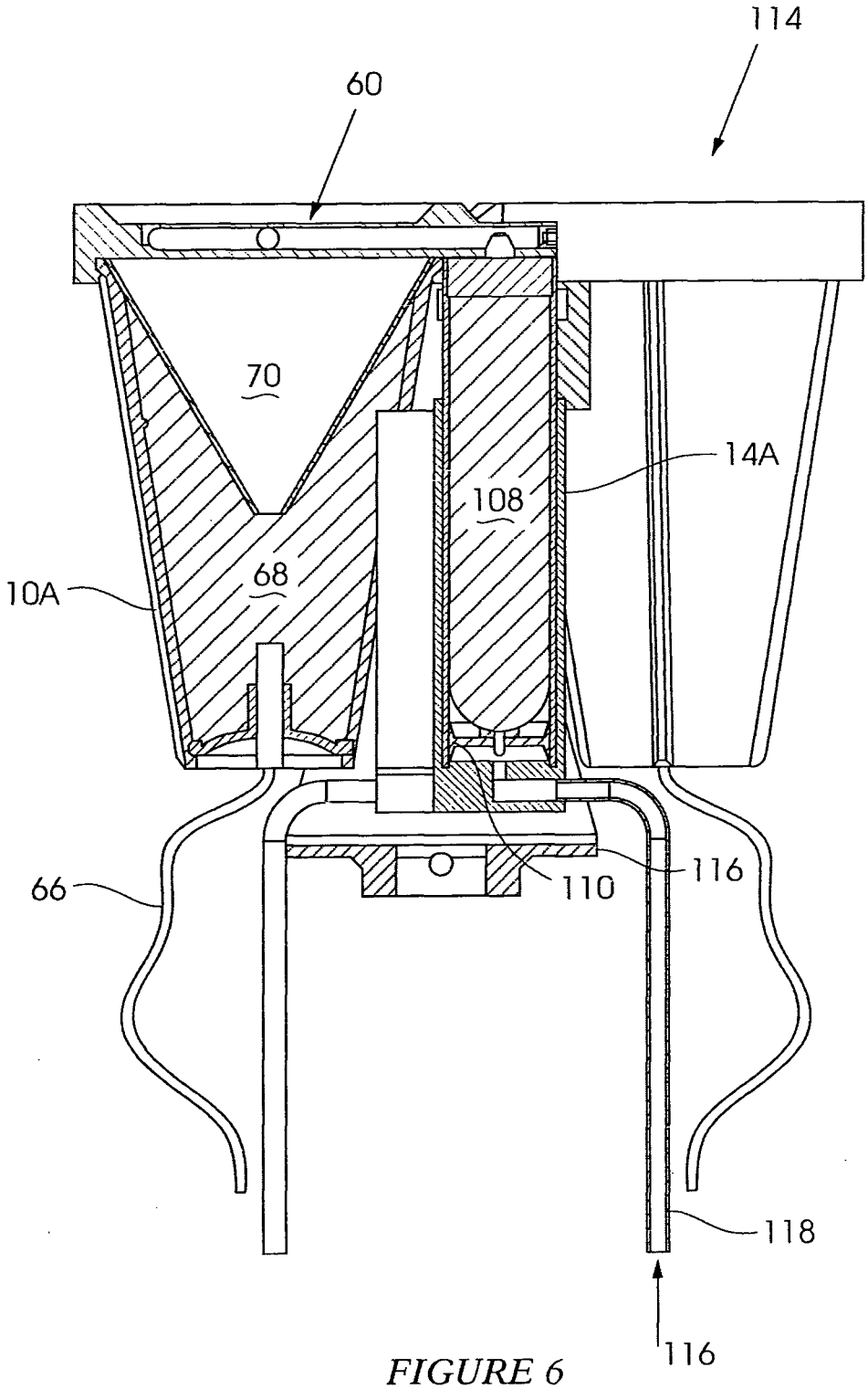
FIG. 6 shows the assembly of FIG. 5 in cross-section.

FIG. 5 shows a surface blasting assembly 114 from one side while FIG. 6 shows the assembly in cross-section. The assembly includes three of the products 10A mounted to a support 116. Each product 10A is of the kind shown in FIG. 4 and includes a respective cylinder 14A which contains fluent adhesive which, in a controlled manner, can be injected into a corresponding recessed formation 60. The individual products 10A are ignited in unison. This is achieved in a configuration in which the leads 70 are interconnected so that one firing signal, applied to the leads, causes simultaneous initiation of the respective detonators and, consequently, the explosives.

The assembly 112 is used when a substantial degree of rock breakage must take place.

The invention claimed is:

1. A surface blasting product, comprising:
- a bellows,
- a container,
- an explosive inside the container,
- a mechanism for initiating the explosive,
- a receptacle which contains an adhesive,
- a conduit connected at a first end to an outlet of the receptacle and connected at a second end to a first end of the container, and
- an actuator arrangement for causing adhesive to be displaced from the receptacle, through the conduit, and onto an outer surface of the first end of the container,
- wherein the container is housed inside the bellows and the bellows has an axial length that is expandable.

2. A surface blasting product according to claim 1 which includes a device, for mixing adhesive which is displaced from the receptacle, adjacent the outer surface of the first end of the container.

3. A surface blasting product according to claim 2 wherein the adhesive includes, at least, a base material and an activator and the receptacle has at least a first compartment for the base material and a second compartment for the activator and the mixing device causes mixing of the base material and the activator.

4. A surface blasting product according to claim 2 wherein the device includes mixing screws.

5. A surface blasting product according to claim 2 wherein the device is located in a recess on the outer surface of the first end of the container.

6. A surface blasting product according to claim 1 wherein the outer surface of the first end of the container has a recessed formation in fluid communication with the receptacle and the adhesive is displaceable into the recessed formation, between the container and a rock to be blasted.

7. A surface blasting product according to claim 1 wherein the actuator includes a flexible bladder inside the receptacle, which contains the adhesive, and a connection for introducing a pressurised fluid into the receptacle thereby to pressurise the bladder externally and so displace adhesive from the bladder.

8. A surface blasting product according to claim 1 wherein the receptacle includes a cylinder which contains the adhesive and the actuator includes a piston which is movable inside the cylinder to displace adhesive from the cylinder.

9. A surface blasting product according to claim 1 which includes a support to which the container is mounted and wherein the container is movable relative to the support.

10. A surface blasting product according to claim 9 wherein the support includes a flexible joint which, in use, is mountable to an elongate component in a manner which permits at least a limited degree of movement of the container relative to the elongate component.

11. A surface blasting product according to claim 1 wherein a shaped charge is included inside the container.

12. A surface blasting product according to claim 11 wherein the container has a conical or pyramidal shape with a base located at the first end of the container and wherein the shaped charge is directly adjacent a base of the container.

13. A surface blasting assembly which includes at least two surface blasting products, each product being according to claim 1, which are configured so that the respective explosives are initiated simultaneously.

14. A surface blasting product according to claim 1 wherein the axial length of the bellows extends from a base end that is fixed to a surface of the receptacle to a distal end that is fixed to the first end of the container.

15. A surface blasting product according to claim 1 wherein the container has a conical or pyramidal shape with a base located at the first end of the container.

16. A surface blasting product according to claim 1 wherein the conduit is external to the container and the bellows.

* * * * *